United States Patent [19]

Petkovic-Luton et al.

[11] Patent Number: 4,619,699

[45] Date of Patent: Oct. 28, 1986

[54] COMPOSITE DISPERSION STRENGTHENED COMPOSITE METAL POWDERS

[75] Inventors: Ruzica Petkovic-Luton, Summit; Joseph Vallone, Roselle, both of N.J.

[73] Assignee: Exxon Research and Engineering Co., Florham Park, N.J.

[21] Appl. No.: 729,742

[22] Filed: May 2, 1985

Related U.S. Application Data

[63] Continuation-in-part of Ser. No. 524,026, Aug. 17, 1983, abandoned.

[51] Int. Cl.[4] ..... B22F 9/00

[52] U.S. Cl. ..... 75/252; 75/254

[58] Field of Search ..... 75/0.5 BC, 252, 254; 419/33

[56] References Cited

U.S. PATENT DOCUMENTS

| | | | |
|---|---|---|---|
| 2,993,467 | 7/1961 | Gatti | 117/100 |
| 3,180,727 | 4/1965 | Alexander et al. | 75/134 |
| 3,463,678 | 8/1969 | Becker | 148/105 |
| 3,723,092 | 3/1973 | Benjamin | 75/0.5 R |
| 3,738,817 | 6/1973 | Benjamin | 419/19 |
| 3,814,635 | 6/1974 | Cometto et al. | 148/11.5 R |
| 3,837,930 | 9/1974 | Cairns et al. | 148/11.5 F |
| 4,129,443 | 12/1978 | Kaufman | 75/212 |

FOREIGN PATENT DOCUMENTS

| | | | |
|---|---|---|---|
| 743845 | 5/1970 | Belgium | 75/232 |
| 922932 | 3/1973 | Canada | 419/33 |
| 2740319 | 9/1978 | Fed. Rep. of Germany | 75/232 |
| 129016 | 11/1978 | Japan | 75/230 |
| 94535 | 1/1982 | Japan | 419/13 |
| 407481 | 3/1934 | United Kingdom | 75/242 |
| 912351 | 12/1962 | United Kingdom | 419/33 |
| 505733 | 3/1976 | U.S.S.R. | 419/33 |

OTHER PUBLICATIONS

Nutting et al; The Development of Microstructure in Incoloy MA 958.

*Primary Examiner*—Wayland Stallard

*Attorney, Agent, or Firm*—Henry E. Naylor

[57] ABSTRACT

Disclosed are dispersion strengthened composite metal powders having an average particle size of less than about 50 microns and an average grain size within the particle of about 0.05 to 0.6 microns.

23 Claims, 7 Drawing Figures

$t_S$ = TIME TO REACH LIMITING GRAIN SIZE $t_S$ IS A FUNCTION OF THE MILLING TIME $t_S$ = TIME TO REACH LIMITING GRAIN SIZE $t_S$ IS A FUNCTION OF THE MILLING TIME

100 μm

100 μm

COMPOSITE DISPERSION STRENGTHENED COMPOSITE METAL POWDERS

CROSS REFERENCE TO RELATED APPLICATIONS

This is a continuation-in-part application of U.S. Ser. No. 524,026 filed Aug. 17, 1983, and now abandoned.

FIELD OF THE INVENTION

The present invention also relates to novel dispersion strengthened composite metal powders having an average particle size of less than about 50 microns and an average grain size within the particle of about 0.05 to 0.6 microns.

BACKGROUND OF THE INVENTION

There is a great need for metal alloys having high strength and good ductility which can withstand adverse environments, such as corrosion and carburization, at increasingly higher temperatures and pressures. The upper operating temperature of conventional heat resistant alloys is limited to the temperature at which second phase particles are substantially dissolved in the matrix or become severely coarsened. Above this limiting temperature, the alloys no longer exhibit useful strength. One class of alloys which is exceptionally promising for such uses for dispersion strengthened alloys obtained by mechanical alloying techniques. These dispersion strengthened alloys, especially the oxide dispersion strengthened alloys, are a class of materials containing a substantially homogeneous dispersion of fine inert particles, which alloys can exhibit useful strength up to temperatures approaching the melting point of the alloy material.

The primary requirement of any technique used to produce dispersion strengthened metallic materials is to create a homogeneous dispersion of a second (or hard) phase which has the following characteristics.

(i) small particle size (<50 nm), preferably oxide particles;

(ii) low interparticle spacing (<200 nm);

(iii) chemically stable second phase, [The negative free energy of formation should be as large as possible. The second phase should not exhibit any phase transformation within the operation range of the alloy];

(iv) the second phase should be substantially insoluble in the metallic matrix.

Dispersion strengthened alloys are generally produced by conventional mechanical alloying methods wherein a mixture of metal powder and second, or hard phase particles are intensively dry milled in a high energy mill, such as the Szeguari attritor. Such a process is taught in U.S. Pat. No. 3,591,362 for producing oxide dispersion strengthened alloys, which patent is incorporated herein by reference. The high energy milling causes repeated welding and fracturing of the metallic phase, which is accompanied by refinement and dispersion of the hard phase particles. The resulting composite powder particles are generally comprised of a substantially homogeneous mixture of the metallic components and an adequate dispersion of the second, or hard phase. The bulk material is then obtained by hot or cold compaction and extrusion to final shape.

One reason for the lack of general adoption of commercial dispersion strengthened alloys, for example oxide dispersion strengthened alloys, by industry has been the lack of technically and economically suitable techniques for obtaining a uniform dispersion of fine oxide particles in complex metal matrices that are free of microstructural defects and that can be shaped into desirable forms, such as tubulars. Although research and development on oxide dispersion strengthened material have continued over the last two decades, the material has failed to reach its full commercial potential. This is because prior to the present invention, development of microstructure during processing which would permit the control of grain size and grain shape in the alloy product was not understood. Furthermore, there was no explanation of the formation of intrinsic microstructural defects introduced during processing, such as oxide stringers, boundary cavities, and porosity.

Oxide stringers consist of elongated patches of oxides of the constituent metallic elements. These stringers act as planes of weakness across their length as well as inhibiting the control of grain size and grain shape during subsequent recrystallization. Porosity, which includes grain boundary cavities, is detrimental to dispersion strengthened alloys because it adversely affects yield strength, tensile strength, ductibility, and creep rupture strength.

Consequently, there is a need in the art for methods of producing dispersion strengthened alloys free of such defects as oxide stringers and porosity.

SUMMARY OF THE INVENTION

In accordance with the present invention, there is provided dispersion strengthened composite metal powders comprised of one or more metals and one or more refractory compounds which powder is characterized as (a) having the refractory substantially homogeneously dispersed throughout the metal matrix, and (b) being substantially free of oxide scale. Preferably the composite powders will have a mean particle size less thant about 50 microns and a mean grain size less than about 0.6 microns.

The metallic constituent may be comprised of one or more metals which melt at high temperatures selected from the group consisting of yttrium, silicon and metals from Groups 4b, 5b, 6b and 8 or one or more metals which melts at a lower temperature such as those selected from Groups 1b, 2b except Hg, 3b, 5a, 2a, 3a and 4a.

The refractory constituent is selected from the group consisting of refractory oxides, carbides, nitrides, borides, oxy-nitrides and carbo-nitrides. In preferred embodiments of the present invention the refractory constituent is a metal oxide such as thoria, yttria and $5Al_2O_3.3Y_2O_3$.

BRIEF DESCRIPTION OF THE FIGURES

FIG. 2A shows a composite particle after being milled in research grade argon for 15 hours in accordance with Comparative Example B hereof and FIG. 2B shows a composite particle after being milled in liquid nitrogen for 5 hours.

FIG. 3A shows such a particle after being milled in air for 24 hours wherein an oxide scale about 10 microns thick can be seen on the outer surface of the particle. FIG. 3B is a particle of the iron base alloy after being milled in liquid nitrogen for 15 hours which evidences the absence of such an oxide scale.

FIG. 4A shows such a particle after milling in argon for 24 hours and heat treating and FIG. 4B shows such a particle after milling in liquid nitrogen for 15 hours and heat treating. The mean grain size of the particle milled in liquid nitrogen is finer than that of a particle milled in argon.

DETAILED DESCRIPTION OF THE INVENTION

The present invention is based on the view that all defects observed in a mechanically composited oxide dispersion strengthened product can be traced to events that take place during the powder milling operation, that is, the first step in a mechanical alloying process.

As previously discussed, oxide stringers are elongated patches of oxides of constituent metallic elements, such as aluminum, chromium, and iron. We have surprisingly discovered that these oxide stringers initiate from oxide scale formed on the particles during ball milling in air, and even more surprisingly in industrial grade argon, when such metals as aluminum, chromium and iron react with available oxygen to form external oxide scales on the metal powders during milling. These scales break during subsequent consolidation and elongate during extrusion to form oxide stringers. The stringers act as centers of weakness in the bulk material as well as serving to inhibit grain boundary migration during annealing. By doing so, they interfere with control of grain size and grain shape during the final thermomechanical treatment steps.

Figure 1:
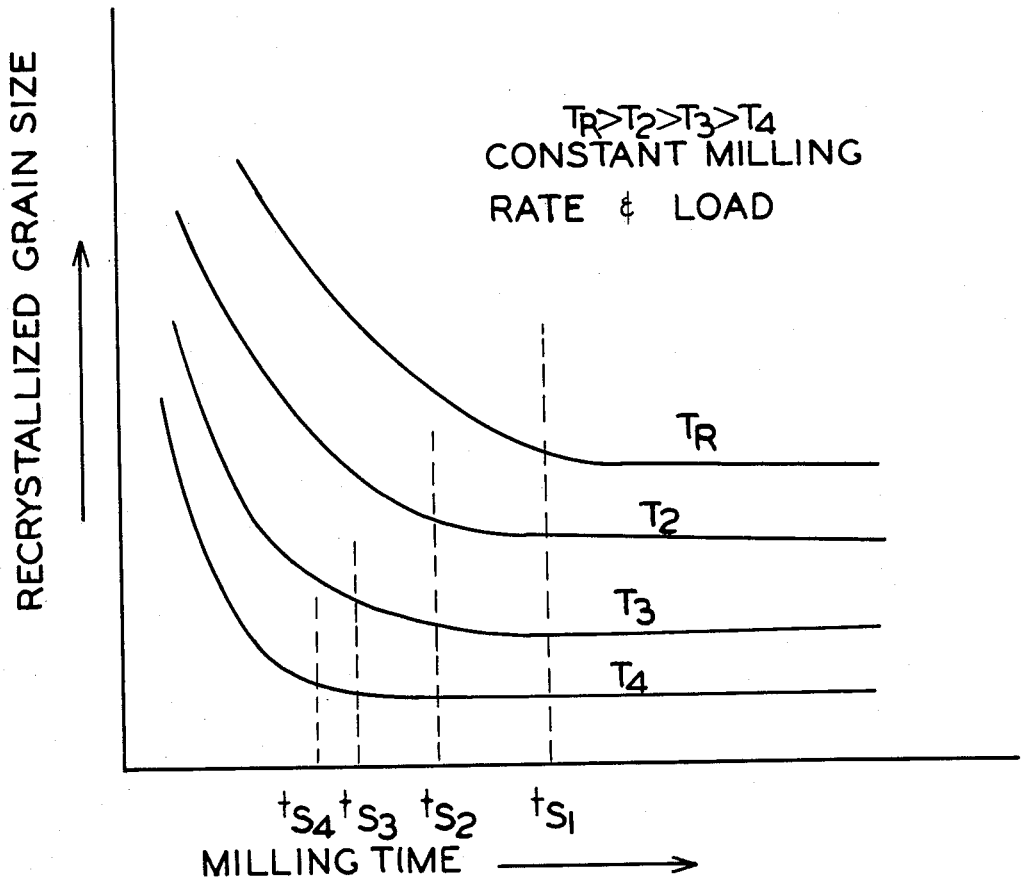
FIG. 1 is a theoretical plot of milling time versus resulting grain size for an iron base yttria dispersion strengthened material at various temperatures.
Figure 2A:
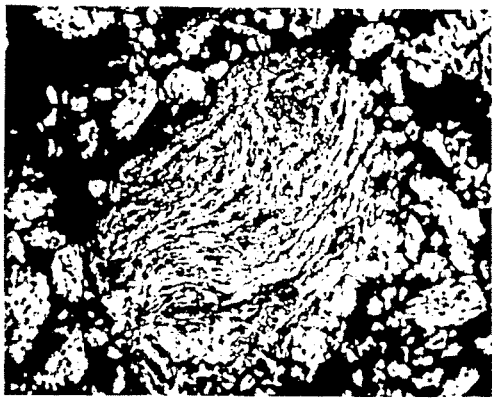
FIGS. 2A and 2B are photomicrographs of iron base yttria dispersion strengthened composite particles which were removed from milling prior to complete homogenization.
Figure 2B:
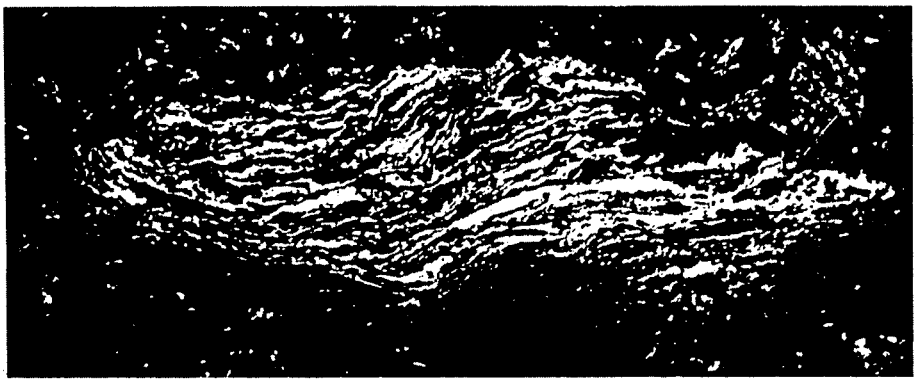
Figure 3B:
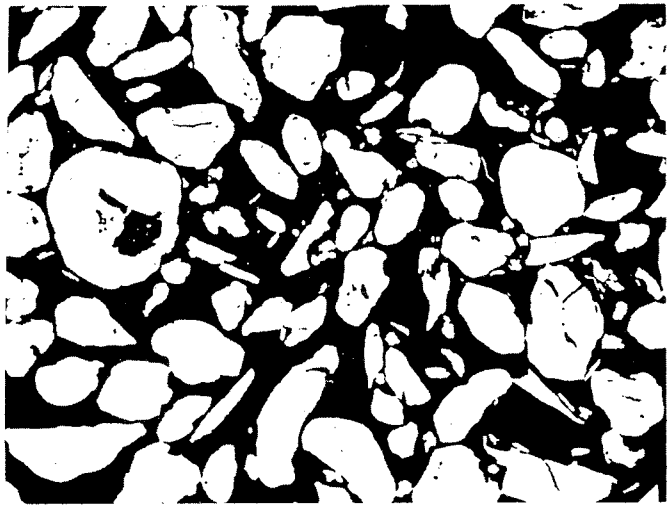
FIGS. 3A and 3B are photomicrographs of iron base yttria dispersion strengthened composite particles after completion of milling.
Figure 3A:
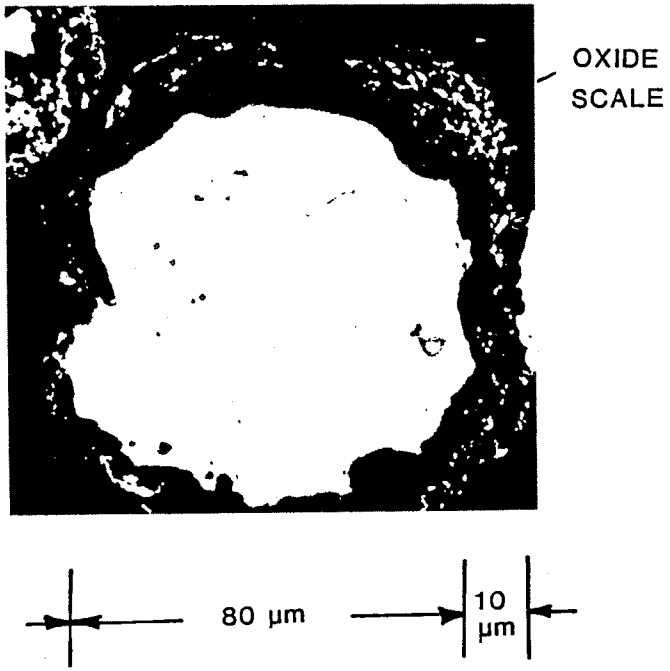
Figure 4A:
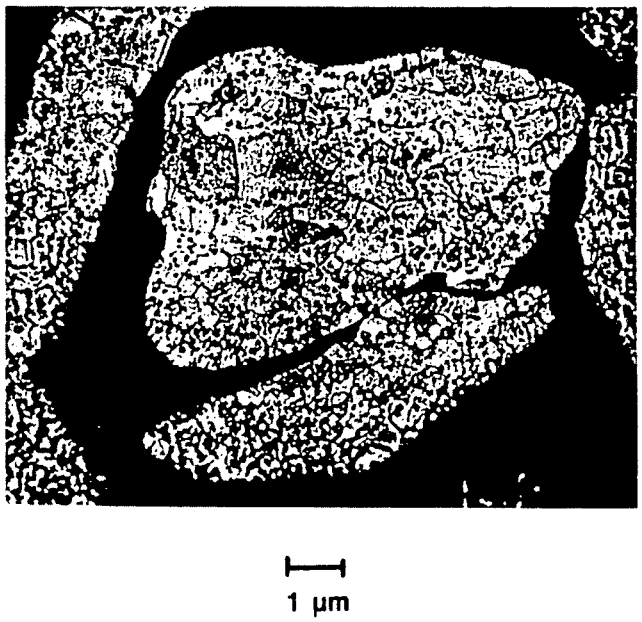
FIGS. 4A and 4B are photomicrographs of iron base yttria dispersion strengthened composite particles after milling and after a 1 hour heat treatment at 1350° C., showing the recrystallized grain structure.
Figure 4B:
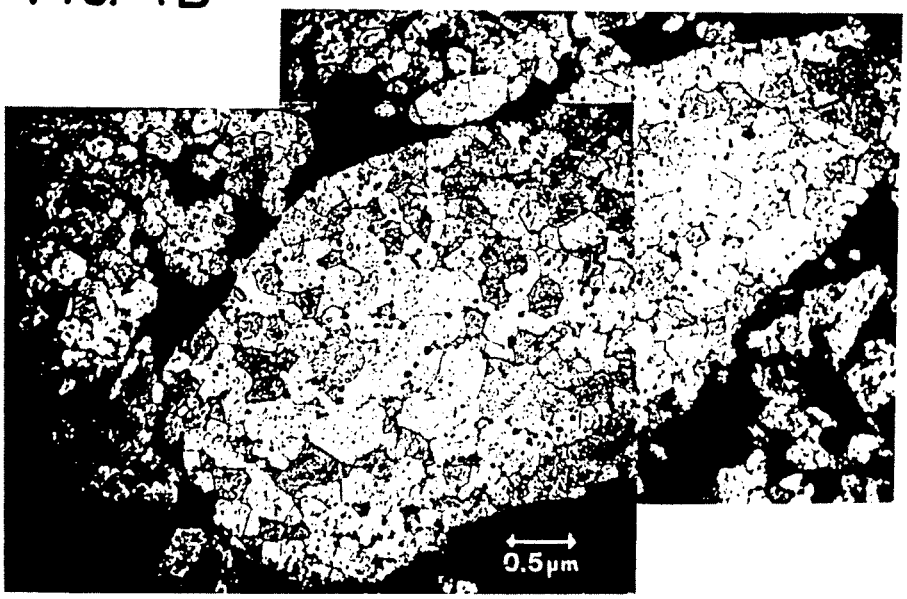

Because mechanical milling of one or more metals is a process in which initial constituent powders are repeatedly fractured and cold welded by the continuous impacting action of milling elements, considerable strain energy is stored during this operation. During subsequent reheating prior to extrusion, recrystallization of the resulting composite powder occurs. It is well-known that the grain size produced by recrystallization after cold working critically depends on the degree of cold working. However, there is a lower limit of work below which recrystallization does not occur. Inasmuch as the degree of cold work is a measure of the strain energy stored in the material, we have found that a decrease in the milling temperature leads to an increase in the amount of work that can be stored in the material over a given period of time and the amount of work that can be stored prior to saturation. Accordingly, a decrease in milling temperature leads to an increase in the rate of reduction of recrystallized grain size as well as a decrease in the grain size achieved at long milling times, as shown in FIG. 1 hereof.

The production of ultra-fine grains during recrystallization prior to extrusion serves to alleviate the tendency of the material to form grain boundary cavities during extrusion and subsequent working. We believe the reason for this is that as the grain size is refined, more and more of the sliding deformation can be accommodated by diffusional processes in the vicinity of the grain boundaries. As a result, the concentration of slip within the grains is reduced and grain boundary concentration of slip bands is proportionally reduced.

The properties of the materials produced by the practice of the present invention herein include: substantially homogeneous dispersion of the refractory (which in the case of the lower melting metals has never before been produced); freedom from oxide scales and, therefore, superior strength of products formed in any manner from these materials (e.g. extrusion, compaction), and a far greater ability to form extruded products substantially free of texture under commercially feasible conditions. Oxide scales formed insitu which are deleterious are distinguished from desirable oxide dispersoids which are purposely added to the material.

Types of materials, that is, a single metal or metal alloys which are of particular interest in the practice of the present invention are the dispersion strengthened materials. The term dispersion strengthened material as used herein are those materials in which metallic powders are strengthened with a hard phase.

The hard phase, also sometimes referred to herein as the dispersoid phase, may be refractory oxides, carbides, nitrides, borides, oxy-nitrides and carbo-nitrides and the like, of such metals as thorium, zirconium, hafnium, and titanium. Refractory oxides suitable for use herein are generally oxides whose negative free energy of formation of the oxide per gram atom of oxygen at about 25° C. is at least about 90,000 calories and whose melting point is at least about 1300° C. Such oxides, as well as those listed above, include oxides of silicon, aluminum, yttrium, cerium, uranium, magnesium, calcium, beryllium, and the like. Also included are the following mixed oxides of aluminum and yttrium: $Al_2O_3.2Y_2O_3$ (YAP), $Al_2O_3.Y_2O_3$ (YAM), and $5Al_2O_3.3Y_2O_3$ (YAG). Preferred oxides include thoria, yttria, and YAG, more preferred are yttria and YAG, and most preferred is YAG.

The amount of dispersoid employed herein need only be such that it furnishes the desired characteristics in the alloy product. Increasing amounts of dispersoid generally provides necessary strength but further increasing amounts may lead to a decrease in strength. Generally, the amount of dispersoid employed herein will range from about 0.5 to 25 vol.%, preferably about 0.5 to 10 vol.%, more preferably about 0.5 to 5 vol.%.

Prior to the present invention it was not practical to mechanically alloy the relatively low melting more malleable metals such as aluminum. This was so because such metals have a tendency to stick to the attritor elements and the walls of the mill. By the practice of the present invention such metals and alloys based on such metals may now be successfully mechanically alloyed by cryogenic milling to produce dispersion strengthened composite particles having a substantially homogeneous dispersion of dispersoid particles throughout the matrix. For purposes of the present invention these more malleable metals will be identified as those metals for which room temperature (25° C.) is the homologous temperature and is between 0.2 and 0.5. Homologous temperature, as used herein is the absolute temperature expressed as a fraction of the melting temperature of the metal. Non-limiting examples of such metals include those selected from Groups 1b, 2b except Hg, 3b, 5a, 2a, 3a and 4a of the Periodic Table of the Elements. Preferred is aluminum. The metals which have a high melting temperature, which are preferred in the practice of the present invention, have a homologous temperature less than about 0.2 and include those metals selected from Groups 4a, 5b, 6b, and 8 of the Periodic Table of the Elements, as well as alloys based on such metals. Preferred are Group VIII metals, more preferred is nickel and iron, and most preferred is iron. The Periodic Table of the Elements referred to herein is the table shown on the inside cover of *The Handbook of Chemistry and Physics*, 65th Edition (1984–1985), CRC Press. High temperature alloys of particular interest in the practice of the present invention are the oxide dispersion strengthened alloys which may contain, by weight; up to 65%, preferably about 5% to 30% chromium; up to 8%, preferably about 0.5% to 6.5% aluminum; up to about 8%, preferably about 0.5% to 6.5% titanium; up to about 40% molydenum; up to about 20% niobium; up to about 30% tantalum; up to about 40% copper; up to about 2% vanadium, up to about 15% manganese; up to about 15% tungsten; up to about 2% carbon, up to about 1% silicon, up to about 1% boron; up to about 2% zirconium; up to about 0.5% magnesium; and the balance being one or more of the metals selected from the group consisting of iron, nickel and cobalt in an amount being at least about 25%. The term, based on, when referred to alloys suitable for use in the practice of the instant invention, means that the metal of highest concentration in the alloy is the metal on which the alloy is based.

In general, the present invention is practiced by charging a cryogenic material, such as liquid nitrogen, into a high energy mill containing the mixture of metal powder and dispersoid particles, thereby forming a slurry. The high energy mill also contains attritive elements, such as metallic or ceramic balls, which are maintained kinetically in a highly activated state of relative motion. The milling operation, which is conducted in the substantial absence of oxygen, is continued for a time sufficient to: (a) cause the constituents of the mixture to comminute and bond, or weld, together and to co-disseminate throughout the resulting metal matrix of the product powder, and (b) to obtain the desired particle size and fine grain structure upon subsequent recrystallization by heating. By substantial absence of oxygen, we mean preferably no oxygen or less than an amount which would cause the formation of oxide scale on the metallic powders. The material resulting from this milling operation can be characterized metallographically by a cohesive internal structure in which the constituents are intimately united to provide an interdispersion of comminuted fragments of the starting constituents. The material produced in accordance with the present invention differs from material produced from identical constituents by conventional milling in that the present material is substantially free of oxide scale and generally has a smaller average particle and grain size upon subsequent thermal treatment. For example, the composite powders based on metals having a homologous temperature of less than 0.2 produced in accordance with the present invention have an average size of up to about 50 microns, and an average grain size of 0.05 to 0.6 microns, preferably 0.1 to 0.6 microns.

Furthermore, by practice of the present invention, the time required for complete homogenization by milling is substantially reduced. For example, dispersion strengthened alloy powders prepared in accordance with the present invention in about 8 hours show a similar degree of homogeneity of chemical composition to identical alloy powders obtained after milling for 24 hours at room temperature, although only under the cryogenic temperatures employed herein can average grain sizes of less than about 0.6 microns be achieved.

The term cryogenic temperature as used herein means a temperature low enough to substantially suppress the annihilation of dislocations of the particles but not so low as to cause all the strain energy to be dissipated by fracture. Temperatures suitable for use in the practice of the present invention will generally range from about −240° C. to −150° C., preferably from about −185° C. to −195° C., more preferably about −195° C. It is to be understood that materials which are liquid at these cryogenic temperatures are suitable for use herein.

Non-limiting examples of cryogenic materials which may be used in the practice of the present invention include the liquified gases nitrogen (b.p. −195° C.), methane (b.p. −164° C.), argon (b.p. −185° C.) and krypton (b.p. −152° C.).

The following examples serve to more fully describe the present invention. It is understood that these examples in no way serve to limit the true scope of this invention, but rather, are presented for illustrative purposes.

The component metal powders used in the following examples were purchased from Cerac Inc. who revealed that : the Cr and Ti powders had been produced by crushing metal ingots; the Al power had been produced by gas atomization; the Fe powder had been produced by an aqueous solution electrolytic technique; and the $Y_2O_3$ particles were produced by precipitation techniques.

Comparative Example A 1500 g of a metal powder mixture comprised of 300 g Cr, 67.5 g Al, 15 g Ti, 7.5 g $Y_2O_3$, and 1110 g Fe was charged into a high speed attritor (ball mill) manufactured by Union Process Inc., Laboratory Model I-S. The attritor contained ¼" diameter steel balls at an initial ratio, by volume, of balls to powder of 20:1.

Milling was carried out in air at room temperature (about 25° C.) and 50 g samples of milled powder were taken for analysis after 1, 2, 3, 6, 9, 12, 15, 18, 21, 24, 27, and 30 hours. Of course, the ball to powder volume ratio increases as samples are withdrawn. For example, after 30 hours the ball to powder ratio has increased to about 32:1. Throughout the milling operation the average ball to powder ratio was about 25:1.

Each of the samples was mounted in a transparent mounting medium, polished, and examined optically in a metallograph for particle size and particle shape. The samples were also examined by scanning electron microscopy, and X-ray emission spectrometry for X-ray mapping of Fe, Cr, and Al. Micrographs were taken of one or more of the resulting composite particles chosen at random and other micrographs were taken of particles above average size to shown as much detail as possible. In addition, samples taken after 6, 9, 15, 21 and 30 hours of milling and were encapsulated in quartz-tubes and heat treated under vacuum at 1350° C. for one hour. Optical and scanning microscopy as well as x-ray mapping were performed on each sample.

The samples were analyzed as indicated above for the following: (i) the change in particle size and shape with milling time, (ii) the change in homogeneity of the powder particles as a function of milling time, and (iii) the influence of the degree of milling on the recrystallization of the alloy powder particles after heat treatment.

Results

The morphology of the composite powder particles after final milling showed relatively large agglomerates having a mean diameter of about 62 microns (μm). The particle size as a function of milling time is shown in Table I below. Metallographic analysis showed that chemical homogenization was completed after 18 hrs and that further milling did not produce significant further refinement of the particle size, nor an increase in the degree of homogenization. The grain size within the particles produced upon heating at 1350° C. is also shown in Table I below.

It can be seen in Table I that the grain size decreased with time to 0.8 m after 30 hrs. Again, no further refinement in grain size was observed with additional milling. It was observed that the powder particles after milling had a thin external oxide scale which was found to be $Al_2O_3$.

TABLE I

| POWDER ATTRITION IN AIR ROOM TEMPERATURE (25° C.) | | |
|---|---|---|
| Milling Time, hr. | Mean Particle Diameter, μm | Recrystallized Grain Size, μm |
| 1 | 190 | — |
| 2 | 200 | — |
| 3 | 215 | — |
| 6 | 173 | 26 |
| 9 | 144 | 10 |
| 12 | 112 | — |
| 15 | 100 | 2.5 |
| 18 | 105 | — |
| 21 | 85 | 1.0 |
| 24 | 79 | — |
| 30 | 62 | 0.8 |

Comparative Example B

The procedure of Comparative Example A was followed except the environment during milling was argon instead of air. The argon employed was research grade having no more than 2 ppm impurities and containing about 0.5 ppm $O_2$.

Results

Particle sizes observed as a function of milling time are shown in Table II below. The grain size obtained after heat treatment at 1350° C. are shown in column 2. It can be seen that the argon environment had little effect on either the particle size or grain size developed on recrystallization. The argon atmosphere, however, inhibited oxidation so that the milled powder particles were relatively free of external oxide scale. Micrographs and X-ray maps of the particles after milling were taken and showed no evidence of higher than average concentration of any of the elements at the surface of the particles. This, of course, further evidences the absence of oxide scales on the surface of the particles during milling.

TABLE II

| POWDER ATTRITION IN ARGON ROOM TEMPERATURE (25° C.) | | |
|---|---|---|
| Milling Time, hr. | Mean Particle Diameter, μm | Recrystallized Grain Size, μm |
| 3 | 161 | — |
| 8 | 105 | 12 |
| 15 | 81 | 3.2 |
| 21 | 71 | 0.9 |

TABLE II-continued

| POWDER ATTRITION IN ARGON ROOM TEMPERATURE (25° C.) | | |
|---|---|---|
| Milling Time, hr. | Mean Particle Diameter, μm | Recrystallized Grain Size, μm |
| 30 | 56 | 0.9 |

Example 1

The procedure of the above examples was followed except the milling was carried out in a liquid nitrogen slurry and the attritor was modified to permit a continuous flow of liquid nitrogen so as to maintain a liquid nitrogen phase in the attritor. Samples were taken after 1, 4, 8, and 15 hours of milling. The powder particle size and recrystallized grain size are shown in Table III below.

TABLE III

| POWDER ATTRITION IN LIQUID NITROGEN | | |
|---|---|---|
| Milling Time, hr. | Mean Particle Diameter, μm | Recrystallized Grain Size, μm |
| 1.0 | 136 | — |
| 4.0 | 90 | 1.1 |
| 8.0 | 25 | 0.6 |
| 15 | 5 | 0.16 |

This example illustrates that by milling under cryogenic conditions, powder agglomerates can be produced of very small particle size and ultra-fine grain size.

Example 2

Three additional runs were made by milling a powder mixture as in the above examples for 5 hours at various cryogenic temperatures. The first run was performed in an environment created by continuously supplying liquid helium which maintained the powder at a temperature of about −207° C. The liquid helium established a gaseous environment during milling. Run 2 was performed in an environment created by continuously supplying a flow of liquid nitrogen and gaseous argon to the attritor at such a ratio that the powder temperature was maintained at about −170° C. Run 3 was performed in an environment created by continuously supplying a flow of liquid nitrogen and gaseous argon to the attritor such that the powder temperature was about −130° C.

The powder particle size and the recrystallized grain size are shown in Table IV below.

This data shows that neither the temperature nor the nature of the gas appear to have a significant influence on the recrystallized grain size as long as the temperature is low enough to substantially suppress the annihilation of dislocations of the particles but not so low as to cause all of the strain energy to be dissipated by fracture. The particle size, however, appears to be less refined at the lowest temperature, −2007° C.

TABLE IV

| POWDER ATTRITION AT VARIOUS CRYOGENIC TEMPERATURES FOR 5 HOURS | | | |
|---|---|---|---|
| Temperature °C. | Environment | Particle Size μm | Grain Size μm |
| −207 | He | 100 | 1.1 |
| −170 | $N_2$ + Ar | 65 | 1.2 |
| −130 | $N_2$ + Ar | 45 | .95 |

What is claimed is:

1. A composite metal powder wherein essentially each powder particle is comprised of one or more metals and one or more refractory compounds wherein the powder particles are characterized as (a) having a cohesive internal structure in which the one or more metals and refractory compounds are intimately united to provide an interdispersion of comminuted fragments of said metals and refractory, (b) having the refractory substantially homogeneously dispersed throughout the metal matrix, and (c) being substantially free of oxide scale; wherein the composite metal powder particles have a mean size less than about 50 microns and a mean grain size within the powder particles of less than about 0.6 microns.

2. The composite powder of claim 1 further characterized as having a mean particle size less than about 50 microns and a mean grain size within the particles of less than about 0.6 microns.

3. The composite metal powder of claim 1 which is based on a metal having a homologous temperature of less than about 0.2.

4. The composite metal powder of claim 3 which is based on a metal selected from the group consisting of yttrium, silicon and metals from Group 4b, 5b, 6b and 8 of the Periodic Table of the Elements.

5. The composite metal powder of claim 4 which is based on a metal selected from Group VIII of the Periodic Table of the Elements.

6. The composite metal powder of claim 5 which is based on nickel or iron.

7. The composite metal powder of claim 6 wherein the refractory constituent is selected from the group consisting of refractory oxides, carbides, nitrides and borides.

8. The composite metal powder of claim 3 wherein the refractory constituent is selected from the group consisting of refractory oxides, carbides, nitrides and borides.

9. The composite metal powder of claim 7 wherein the refractory is a metal oxide.

10. The composite metal powder of claim 8 wherein the refractory is a metal oxide.

11. The composite metal powder of claim 10 wherein the refractory is present in an amount from about 0.5 to 5 volume %.

12. The composite metal powder of claim 9 wherein the refractory is present in an amount from about 0.5 to 5 volume %.

13. The composite metal powder of claim 12 wherein the refractory oxide is selected from the group consisting of thoria, yttria, $Al_2O_3.2Y_2O_3$, $Al_2O_3.Y_2O_3$ and $5Al_2O_3.3Y_2O_3$.

14. The composite metal powder of claim 13 wherein the oxide is selected from yttria, $5Al_2O_3.3Y_2O_3$, or a mixture thereof.

15. The composite metal powder of claim 14 which is comprised of, by weight based on the total weight of the powder, up to about 65% chromium, up to about 8% aluminum, up to about 8% titanium, up to about 40% molybdenum, up to about 20% niobium, up to about 30% tantalum, up to about 40% copper, up to about 2% vanadium, up to about 15% tungsten, up to about 15% manganese, up to about 2% carbon, up to about 1% silicon, up to about 1% boron, up to about 2% zirconium, up to about 0.5% magnesium, up to about 25 volume % of a refractory oxide, and the balance being one or more of the metals selected from the group consisting of iron, nickel, and cobalt in an amount being at least about 25%.

16. The composite metal powder of claim 15 wherein the refractory oxide is in an amount from about 0.5% to about 5 volume %.

17. The composite metal powder of claim 1 which is based on a metal whose homologous temperature is from about 0.2 to 0.5.

18. The composite metal powder of claim 17 which is based on a metal selected from Groups 1b, 2b, 3b, 5a, 2a, 3a and 4a.

19. The composite metal powder of claim 18 which is aluminum or aluminum based.

20. The composite metal powder of claim 19 wherein the refractory is selected from the group consisting of refractory oxides, carbides, nitrides, and borides.

21. The composite metal powder of claim 20 wherein the refractory is a metal oxide.

22. The composite metal powder of claim 21 wherein the metal oxide is alumina.

23. The composite metal powder of claim 22 wherein the alumina is present in an amount from about 0.5 to about 5 volume percent.

* * * * *